US011177547B1

(12) United States Patent
Harper et al.

(10) Patent No.: US 11,177,547 B1
(45) Date of Patent: Nov. 16, 2021

(54) THREE-DIMENSIONAL BRANCH LINE COUPLER

(71) Applicant: Raytheon Company, Waltham, MA (US)

(72) Inventors: Elicia K. Harper, Chelsea, MA (US); Christopher M. Laighton, Boxborough, MA (US); Francois Y. Colomb, Westford, MA (US)

(73) Assignee: RAYTHEON COMPANY, Waltham, MA (US)

( * ) Notice: Subject to any disclaimer, the term of this patent is extended or adjusted under 35 U.S.C. 154(b) by 0 days.

(21) Appl. No.: 16/867,067

(22) Filed: May 5, 2020

(51) Int. Cl.
*H01P 5/16* (2006.01)
*H01P 3/08* (2006.01)
*H01P 1/18* (2006.01)

(52) U.S. Cl.
CPC ..... *H01P 5/16* (2013.01); *H01P 1/184* (2013.01); *H01P 3/08* (2013.01)

(58) Field of Classification Search
CPC ..... H01P 5/16; H01P 1/184; H01P 3/08
See application file for complete search history.

(56) References Cited

U.S. PATENT DOCUMENTS

| | | | |
|---|---|---|---|
| 4,185,258 A | 1/1980 | Cote et al. | |
| 4,751,453 A | 6/1988 | Foti | |
| 6,437,661 B2 | 8/2002 | Nishimura et al. | |
| 6,822,532 B2 | 11/2004 | Kane et al. | |
| 7,646,261 B2 | 1/2010 | Kirkeby | |
| 8,177,348 B2 | 5/2012 | Sidhu et al. | |
| 9,035,719 B2 * | 5/2015 | Dewitt | H01P 3/003 333/117 |
| 9,225,291 B2 | 12/2015 | Ahmed et al. | |
| 9,584,080 B2 | 2/2017 | Laighton et al. | |
| 9,887,195 B1 | 2/2018 | Drab et al. | |
| 10,930,995 B2 * | 2/2021 | Yoshioka | H01P 5/19 |

(Continued)

FOREIGN PATENT DOCUMENTS

| | | |
|---|---|---|
| EP | 1 139 487 A1 | 10/2001 |
| JP | S60242703 A | 12/1985 |

OTHER PUBLICATIONS

Nishant Gupta, Raghuvir Tomar, A Low-Loss Voltage-Controlled Analog Phase-Shifter Using Branchline Coupler and Varactor Diodes, The LNM Institute of Information Technology and NATEL Engineering Co., Inc., IEEE, Jul. 2, 2007, (2 pages).

(Continued)

*Primary Examiner* — Robert J Pascal
*Assistant Examiner* — Kimberly E Glenn
(74) *Attorney, Agent, or Firm* — Daly, Crowley, Mofford & Durkee, LLP

(57) ABSTRACT

A branchline coupler structure having a pair of main transmission lines disposed on different horizontal levels of a support structure and a pair of shunt transmission lines, vertically disposed and laterally spaced, and disposed in the support structure. A first one of the pair of shunt transmission lines is coupled between: one region of a first one of the pair of main transmission lines and a first end of a second one of the pair of main transmission line. A second one of the pair of shunt transmission lines is coupled between a second region of the first one of the pair of main transmission lines, laterally spaced from the first region, and a second end of the second one of the main transmission lines.

9 Claims, 14 Drawing Sheets

(56) References Cited

U.S. PATENT DOCUMENTS

| | | | |
|---|---|---|---|
| 2016/0014906 | A1 | 1/2016 | Ilic et al. |
| 2019/0036189 | A1 | 1/2019 | Laighton et al. |
| 2019/0074567 | A1 | 3/2019 | Laighton et al. |

OTHER PUBLICATIONS

J. Piotr Starski, Optimization of the Matching Network for a Hybrid Coupler Phase Shifter, IEEE, vol. MTT-25, No. 8, Aug. 1977, pp. 662-666 (5 pages).

F. Ferrero, C. Luxey, G. Jacquemod, R. Staraj, G. Kossiavas, V.Fusco, Reconfigurable phased-arrays based on hybrid couplers in reflection mode, Université de Nice-Sophia Antipolis, IEEE Feb. 13, 2017, (4 pages).

M.H. Kori, ME, Prof. S. Mahapatra, PhD., Integral analysis of hybrid coupled semiconductor phase shifters, IEEE, vol. 134, Pt. H, No. 2, Apr. 1987, pp. 156-162 (7 pages).

Ozan Dogan Gurbuz, Gabriel M. Rebeiz, A. 1.6-2.3-GHz RF MEMS Reconfigurable Quadrature Coupler and Its Application to a 360 Reflective-Type Phase Shifter, IEEE, vol. 63, No. 2, Feb. 2015, pp. 414-421 (8 pages).

Bijan K.Tehrani, Benjamin S, Cook, Manos M.Tentzeris, Inkjet-Printed 3D Interconnects for Millimeter-Wave System-on-Package Solutions, IEEE, 2016, 4 pages.

David S. Ricketts, 3dB Branchline Coupler, 2019, 15 pages.

M. Galarza, D. Van Thourhout, R. Baets, Compact and Highly-Efficient Vertical Couplers for Active-Passive Monolithic Integrations, Optical Society of America, 2005, 3 pages.

Notice of Allowance and Issue Fee due, dated Nov. 20, 2018, U.S. Appl. No. 15/659,877, 8 pages.

PCT International Search Report and Written Opinion dated Jun. 21, 2021 for International Application No. PCT/US2021/020624; 15 Pages.

* cited by examiner

THREE-DIMENSIONAL BRANCH LINE COUPLER

TECHNICAL FIELD

This disclosure relates generally to branchline couplers and more particularly to compact branchline couplers.

BACKGROUND OF THE INVENTION

As is known in the art, one type of analog phase shifter includes a branchline coupler. One such branchline coupler, sometimes also referred to as a reflective coupler or a shunt hybrid combiner, is shown in FIG. 1 to include a pair of main transmission lines and a pair of shunt transmission lines. One analog phase shifter, (FIG. 2) that includes a branchline coupler is described in a paper entitled "Integral analysis of hybrid coupler semiconductor phase shifters" by Kori et al, IEE Proceedings, vol. 134, Pt. H. No. 2. April 1987.

One technique used to adjust phase shift of the branchline coupler type phase shifter is to connect a phase adjusting section connected to each one of the pair of shunt transmission lines as described in a paper entitled "A Low-Loss Voltage-Controlled Analog Phase-Shifter Using Branchline Coupler and Varactor Diodes" by Gupta et al., (Gupta, Nishant, Raghuvir Tomar, and Prakash Bhartia. "A low-loss voltage-controlled analog phase-shifter using branchline coupler and varactor diodes." Microwave and Millimeter Wave Technology, 2007. ICMMT07. International Conference on. IEEE, 2007). There a pair of varactor diodes is controlled by voltages to adjust the phase shift provided by the phase shifter. Another branchline coupler type phase shifter having a phase adjusting section connected to each one of the pair of shunt transmission lines is shown in FIG. 3A. Here the phase adjusting sections each includes a pair of conductors separated one from and the other; one of the conductors being connected to a ground plane conductor on the bottom of a substrate. The two conductors are connected by a series of bridging, spaced bond wires, as shown. With an input signal applied, the phase at the output is measured and the bond wires are removed one at a time, as shown in FIG. 3B, to thereby change the electrical length of the path through the phase adjusting sections to ground until the desired phase shift is obtained; FIG. 3B showing several of the bond wires removed from the branchline coupler type phase shifter of FIG. 3A.

SUMMARY OF THE INVENTION

In accordance with the present disclosure a branchline coupler structure is provided, comprising: a support structure; a pair of main transmission lines disposed on different horizontal levels of the support structure; and a pair of shunt transmission lines, vertically disposed and laterally spaced, and disposed in the support structure. A first one of the pair of shunt transmission lines is coupled between: one region of a first one of the pair of main transmission lines and a first end of a second one of the pair of main transmission line. A second one of the pair of shunt transmission lines is coupled between a second region of the first one of the pair of main transmission lines, laterally spaced from the first region, and a second end of the second one of the main transmission lines.

In one embodiment, the branchline coupler structure includes: a pair of phase adjusting sections, each one of the pair of phase shifting sections being coupled to a corresponding one of a pair of shunt transmission line sections through a corresponding one of pair phase shifter section transmission lines, the pair phase shifter section transmission lines being disposed on an upper surface of the support structure. A ground pad is disposed on an upper surface of the support structure, separate from the signal strip conductors of the phase shifter section transmission lines by gaps; and a plurality of electrical conductors, bridging the gaps, disposed successive along over the gaps, each one of the plurality of electrical conductors having one end to connect the ground pad and a second end connected to the phase shifter transmission line sections.

In one embodiment, the branchline coupler structure includes: a second ground pad disposed on an upper surface of the support structure, separate from the signal strip conductors of the pair of phase shifter section transmission lines by a pair of gaps; and a second plurality of electrical conductors, bridging the pair of gaps, disposed successive along over the pair of gaps, each one of the second plurality of electrical conductors having one end connect the second ground pad and a second end connected to the corresponding one of the phase shifter transmission line sections.

In one embodiment, the first-mentioned plurality of electrical conductors and the second plurality of electrical conductors are staggered along the first mentioned gap and a corresponding one of the pair of gaps.

In one embodiment, pair of shunt transmission lines propagate energy with the electric field of such energy being disposed vertically.

In one embodiment, the pair of main transmission lines propagate energy with the electric field of such energy being disposed horizontally.

In one embodiment, a branchline coupler structure is proved comprising: a pair of main transmission lines; a pair of shunt transmission lines, a first one of the pair of shunt transmission lines is coupled between: one region of a first one of the pair of main transmission lines and a first end of a second one of the pair of main transmission line, a second one of the pair of shunt transmission lines is coupled between a second region of the first one of the pair of main transmission lines, laterally spaced from the first region, and a second end of the second one of the main transmission lines; a pair of phase adjusting sections, each one of the pair of phase shifting sections being coupled to a corresponding one of a pair of shunt transmission line sections through a corresponding one of pair phase shifter section transmission lines; a ground pad disposed on an upper surface of the support structure, separate from the signal strip conductors of the phase shifter section transmission lines by gaps; and a plurality of electrical conductors, bridging the gaps, disposed successive along over the gaps, each one of the plurality of electrical conductors having one end to connect the ground pad and a second end connected to one of the phase shifter transmission line sections.

In one embodiment, a second ground pad disposed on an upper surface of the support structure, separate from the signal strip conductors of the pair of phase shifter section transmission lines by a pair of gaps. A second plurality of electrical conductors, bridging the pair of gaps, is disposed successive along over the pair of gaps, each one of the second plurality of electrical conductors having one end connect the second ground pad and a second end connected to the corresponding one of the phase shifter transmission line sections.

In one embodiment, the first-mentioned plurality of electrical conductors and the second plurality of electrical conductors are staggered along the first mentioned gap and a corresponding one of the pair of gaps.

With such an arrangement a compact branchline coupler is provided. Also, the number of phase shifts available is increased by providing the second ground pad.

The details of one or more embodiments of the disclosure are set forth in the accompanying drawings and the description below. Other features, objects, and advantages of the disclosure will be apparent from the description and drawings, and from the claims.

BRIEF DESCRIPTION OF THE DRAWINGS

Like reference symbols in the various drawings indicate like elements.

DETAILED DESCRIPTION

Figure 1:
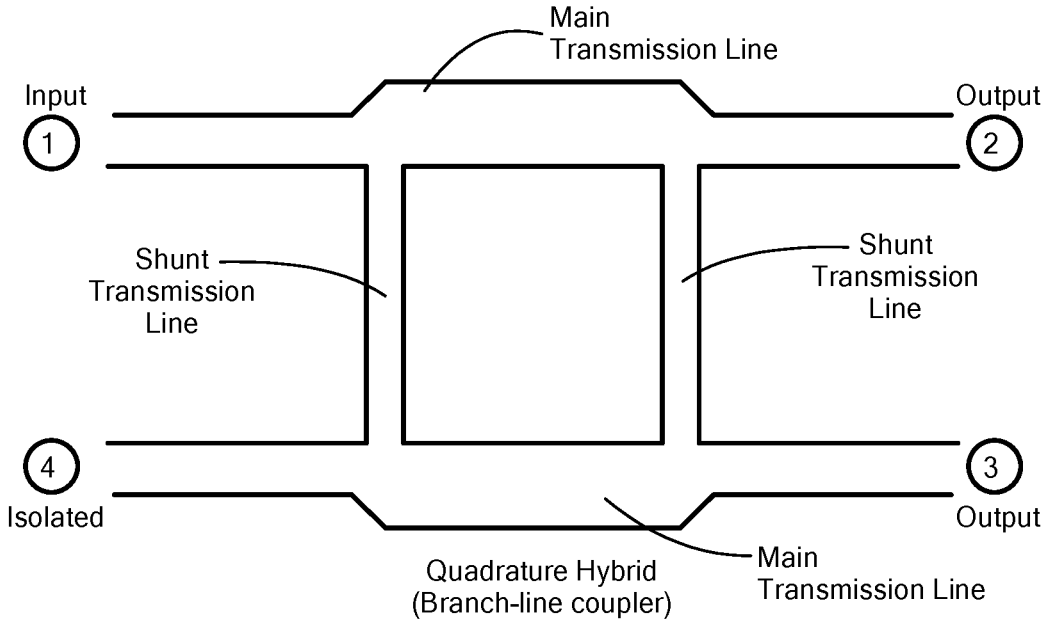
FIG. 1 PRIOR ART
FIG. 1 is a schematic diagram of a branchline coupler according to the PRIOR ART.
Figure 2:
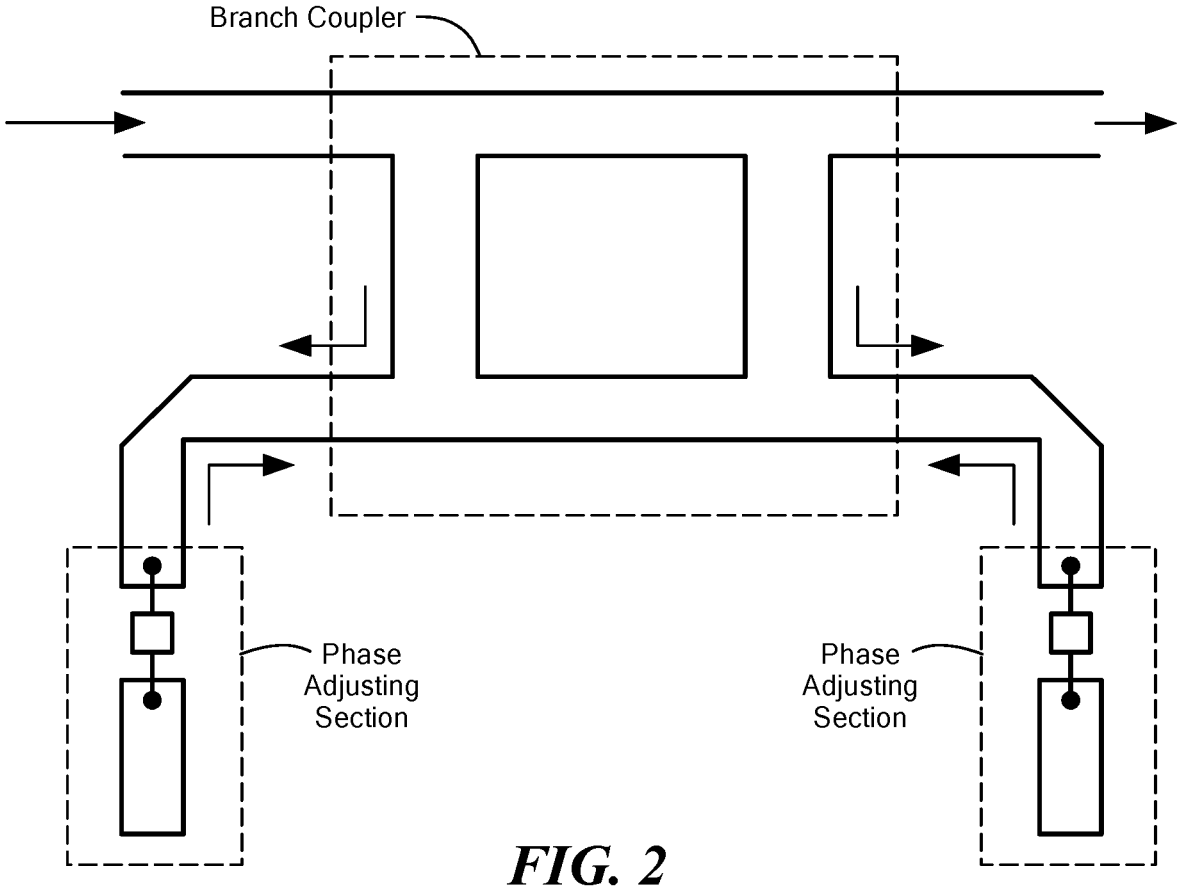
FIG. 2 PRIOR ART
FIG. 2 is a schematic diagram of a phase shifter using a branchline coupler according to the PRIOR ART.
Figure 3A:
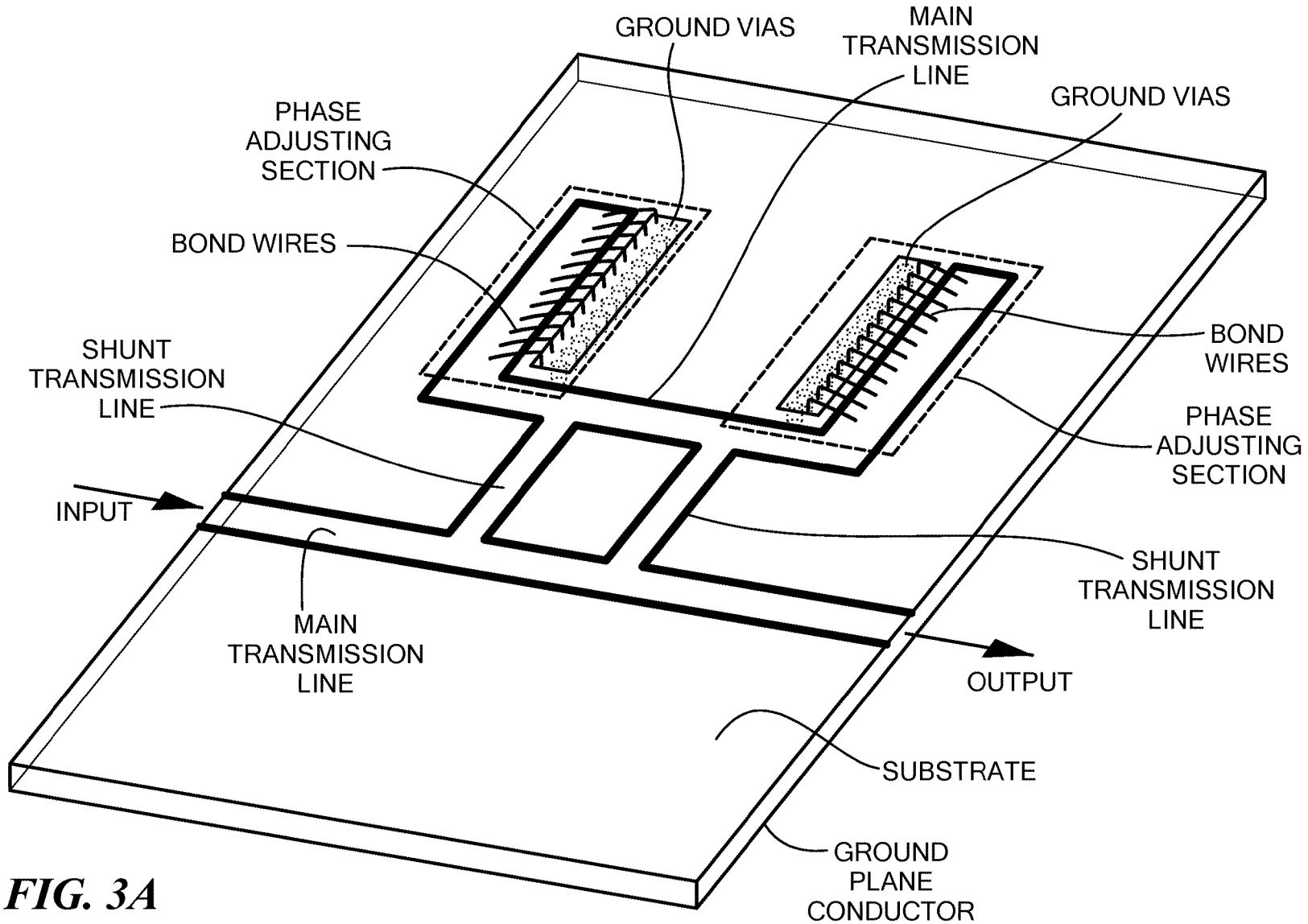
FIG. 3A PRIOR ART
FIGS. 3A and 3B are perspective views of a phase shifter using a branchline coupler according to the PRIOR ART at various stages in the fabrication thereof according to the PRIOR ART.
Figure 3B:
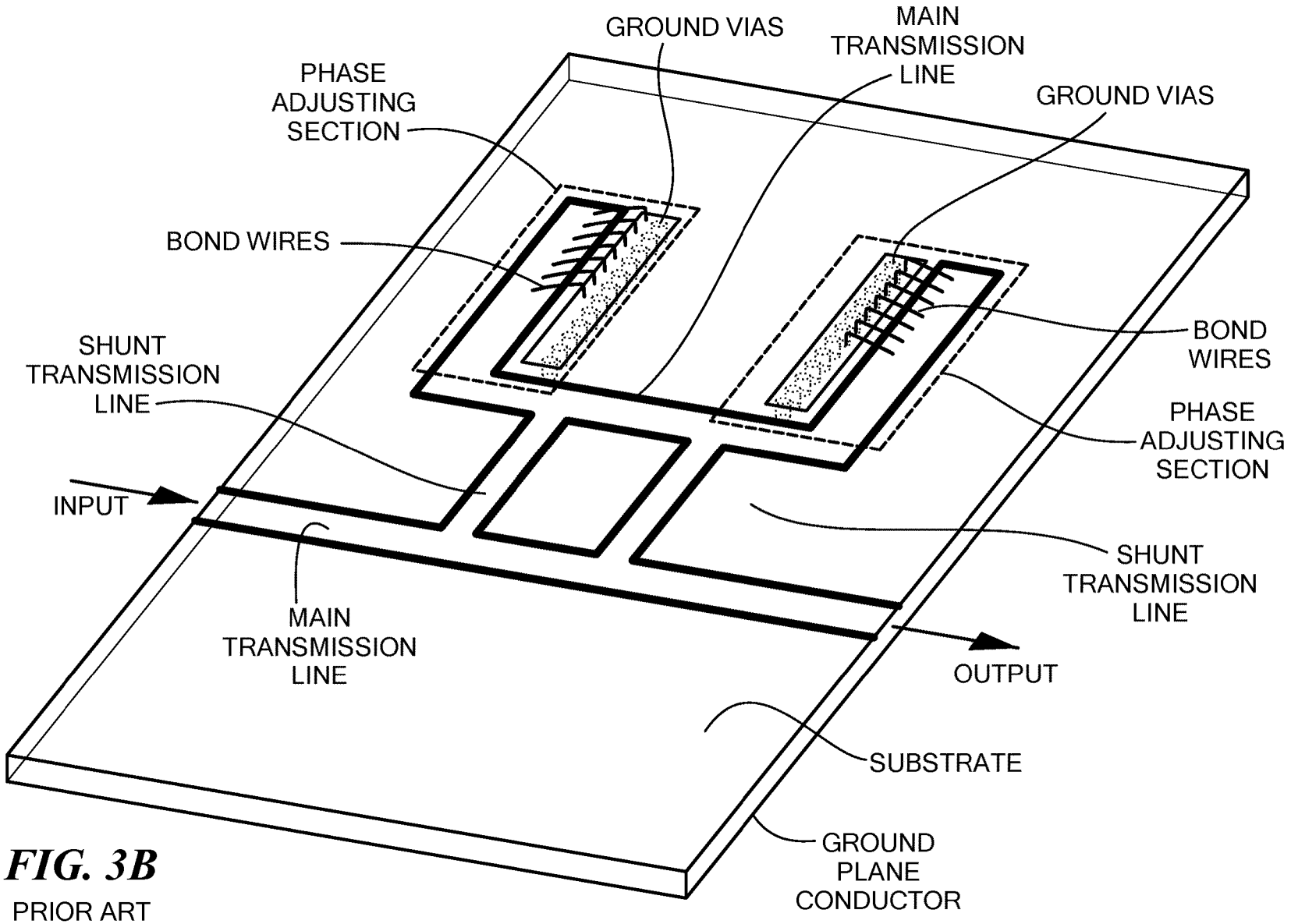
FIG. 3B PRIOR ART
Figure 4:
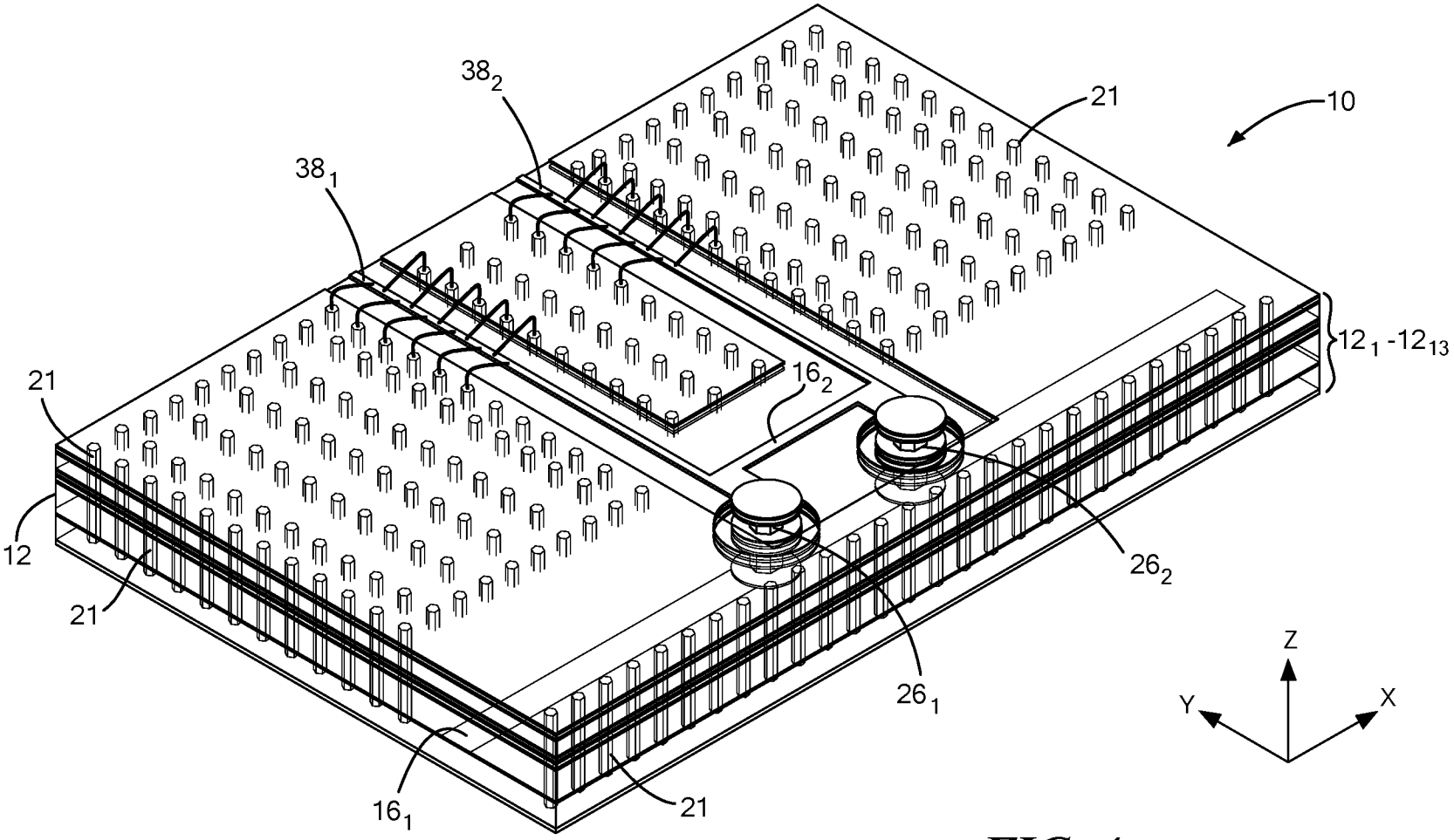
FIG. 4 is a perspective view, partially shown in phantom, of a branchline coupler according to the disclosure.
Figure 4A:
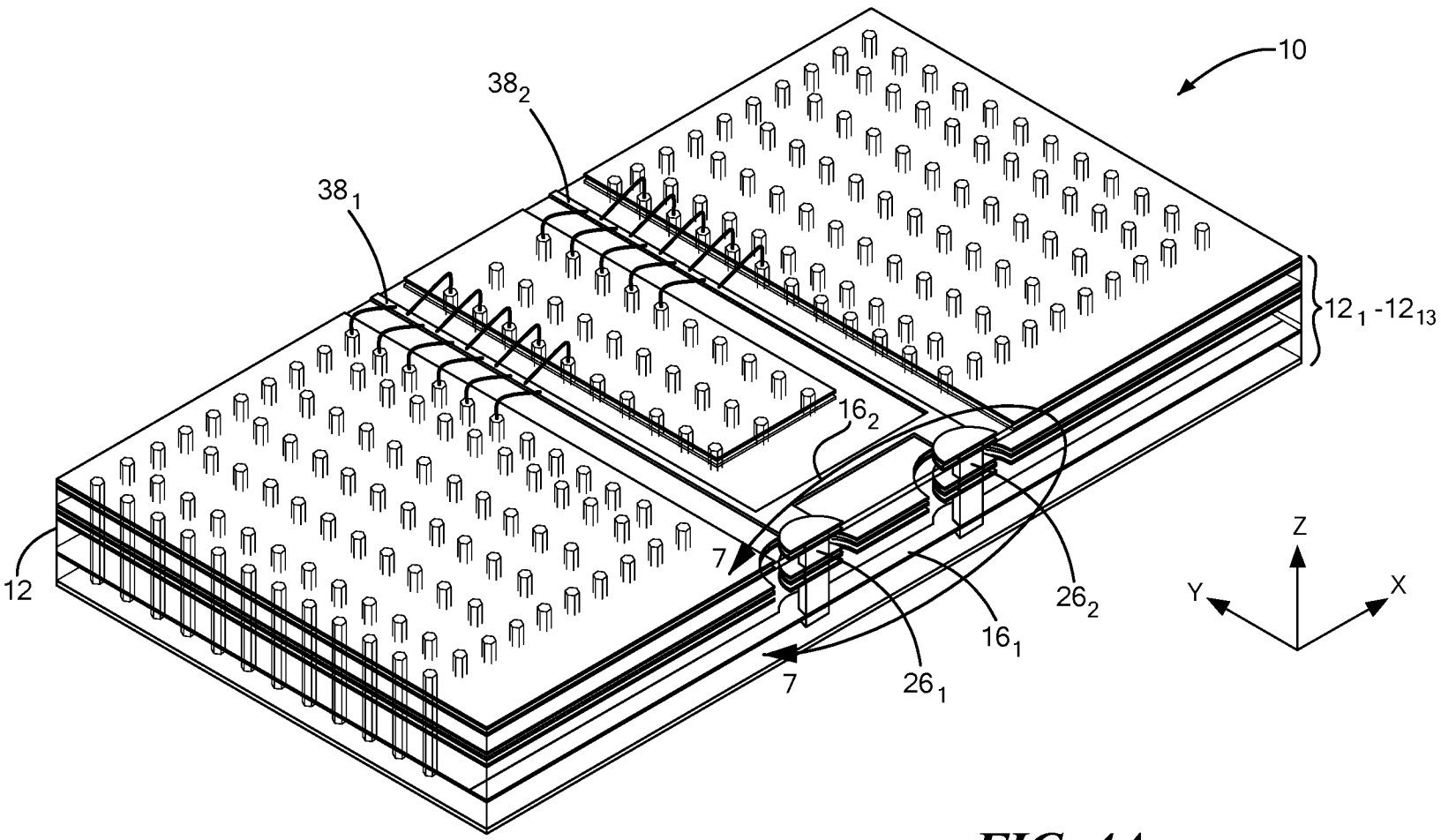
FIG. 4A is the perspective of view, partially shown in phantom, of the branchline coupler of FIG. 4 with a portion thereof removed to show inner layers of the branchline coupler according to the disclosure, such inner portion being encircled by an arrow designated 7-7 and shown in FIG. 7.
Figure 4B:
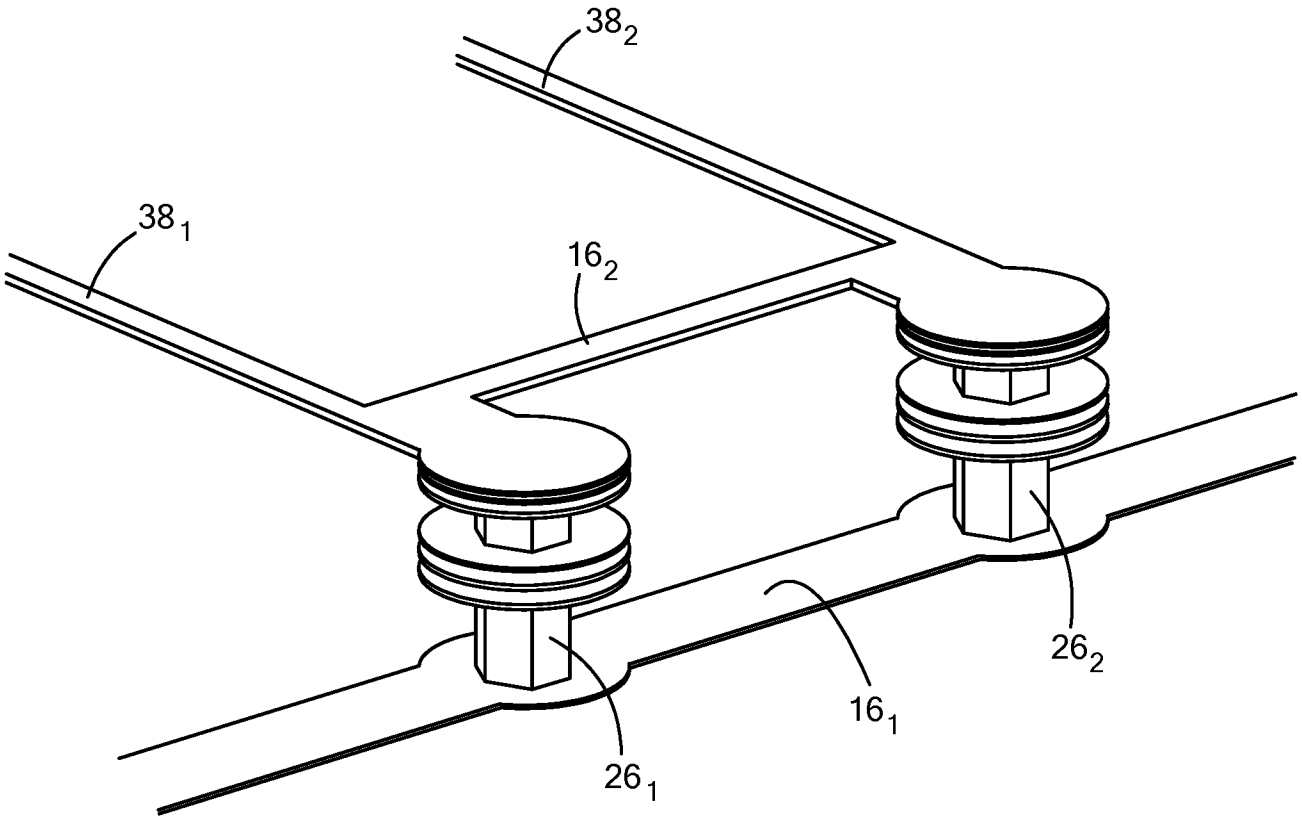
FIG. 4B shows the signal conductors used in the branchline coupler of FIG. 4 according to the disclosure.
Figure 5:
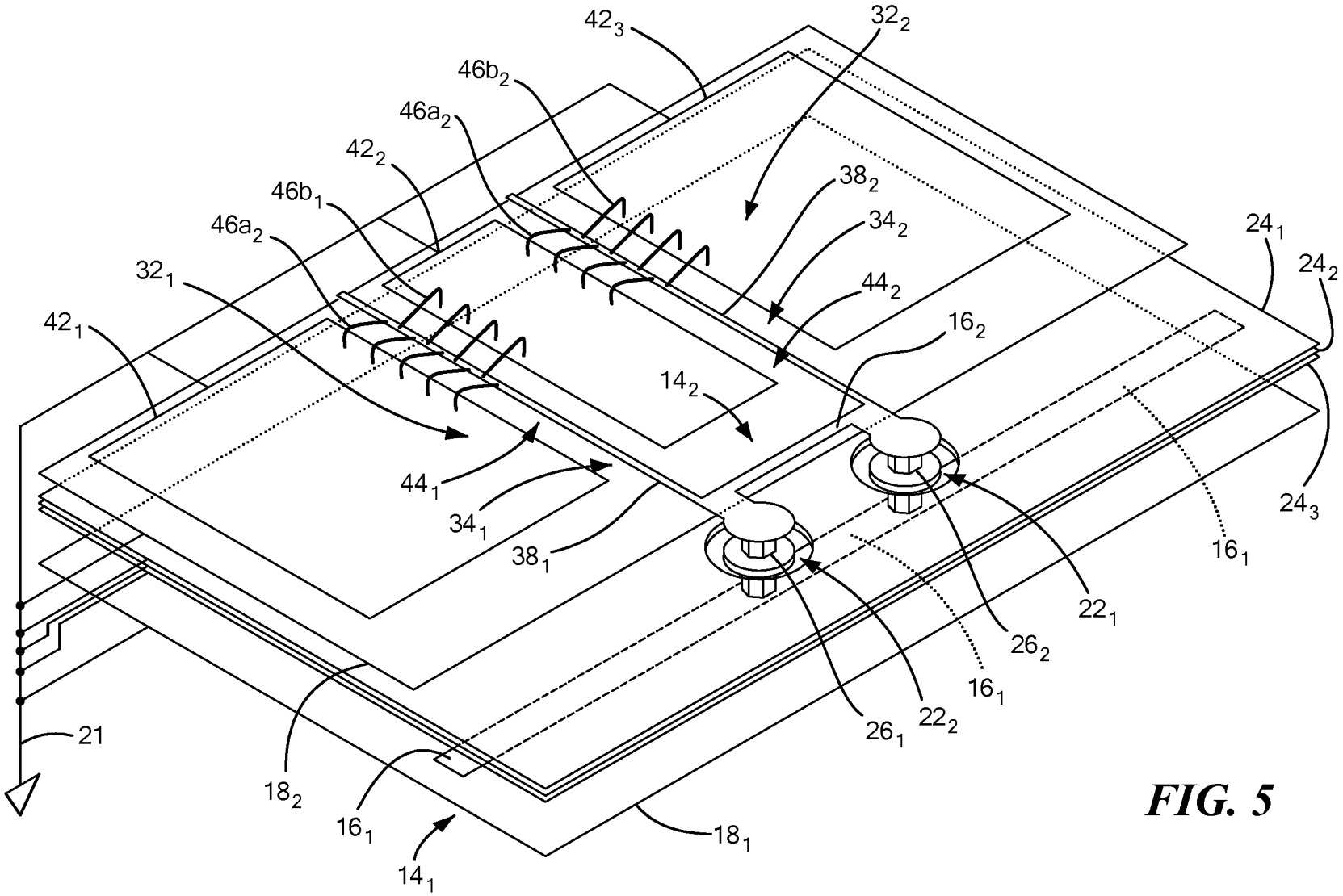
FIG. 5 is an exploded, perspective sketch showing each one of a plurality of vertically stacked printed circuit boards of the branchline coupler of FIG. 4 according to the disclosure.

Referring now to FIGS. 4, 4A, 4B and 5, a branchline coupler structure 10 is shown. The branchline coupler structure 10 incudes: a support structure 12 (FIG. 4A) here a dielectric structure comprising a plurality of, here thirteen, planar printed circuit boards $\mathbf{12}_1$-$\mathbf{12}_{13}$, vertically stacked along the Z-axis, as shown in FIG. 6, the planar surfaces of the boards $\mathbf{12}_1$-$\mathbf{12}_{13}$ being disposed in horizontal (X-Y) planes, the top view of each one of the plurality of printed circuit boards $\mathbf{12}_1$-$\mathbf{12}_{13}$ being shown in FIGS. 5A-5M, respectively; the top one of the boards $\mathbf{12}_1$-$\mathbf{12}_{13}$ being designated as $\mathbf{12}_1$ and the bottom one of the boards $\mathbf{12}_1$-$\mathbf{12}_{13}$ being labelled $\mathbf{12}_{13}$. When the plurality of printed circuits boards $\mathbf{12}_1$-$\mathbf{12}_{13}$ are bonded together with any conventional dielectric bonding material, not shown, the branchline coupler structure 10 forms, as shown diagrammatically in FIG. 5; the signal strip conductors $\mathbf{16}_1$,$\mathbf{16}_2$, inner signal conductors $\mathbf{26}_1$,$\mathbf{26}_2$ and signal strip conductors $\mathbf{38}_1$,$\mathbf{38}_2$, of the branchline coupler 10, to be described in more detail below, being shown in FIG. 4B.

Figure 5A:
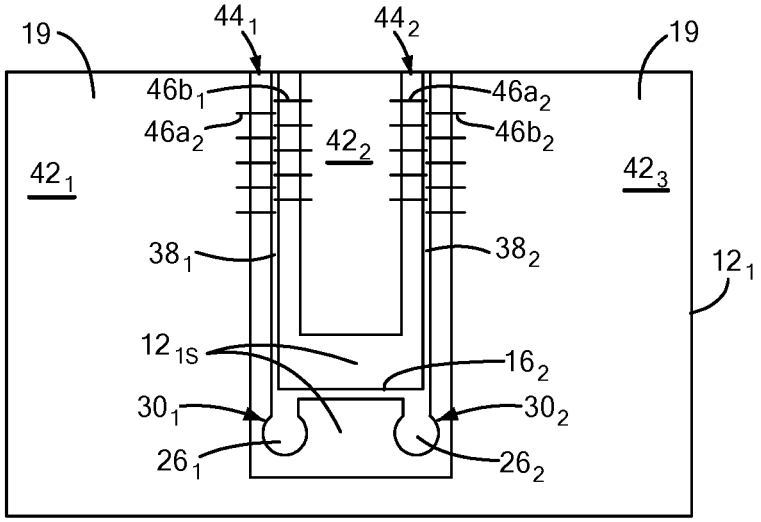
FIGS. 5A-5M are top views of each one of the printed circuit boards of FIG. 5 used to form the branchline coupler of FIG. 4 according to the disclosure.
Figure 5B:
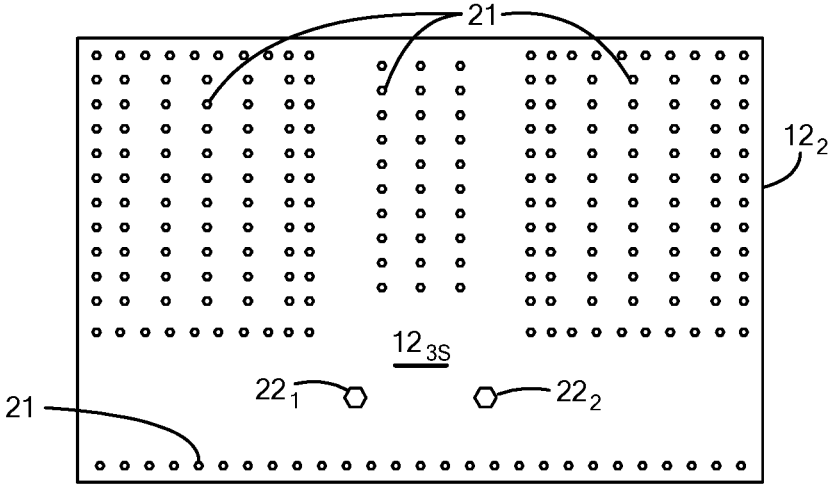
Figure 5C:
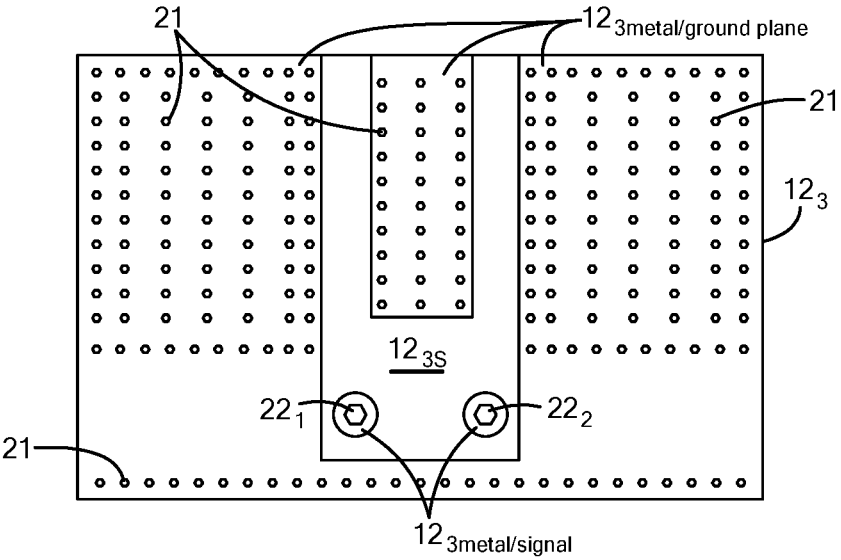
Figure 5D:
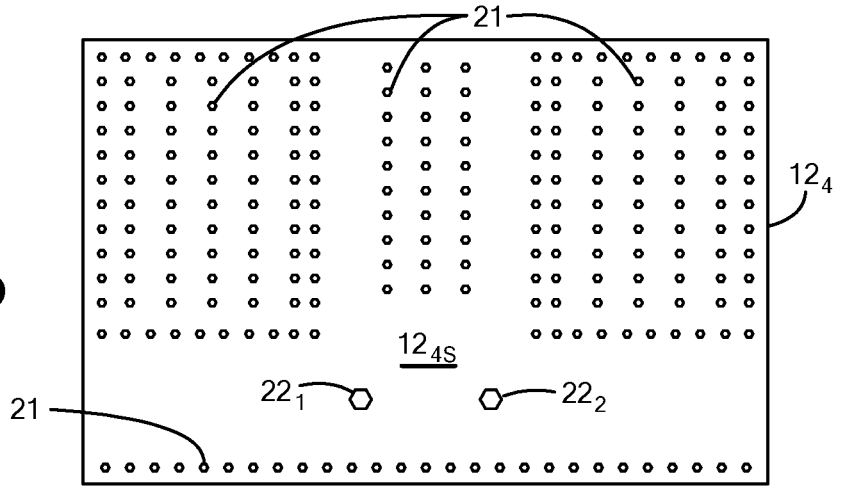
Figure 5E:
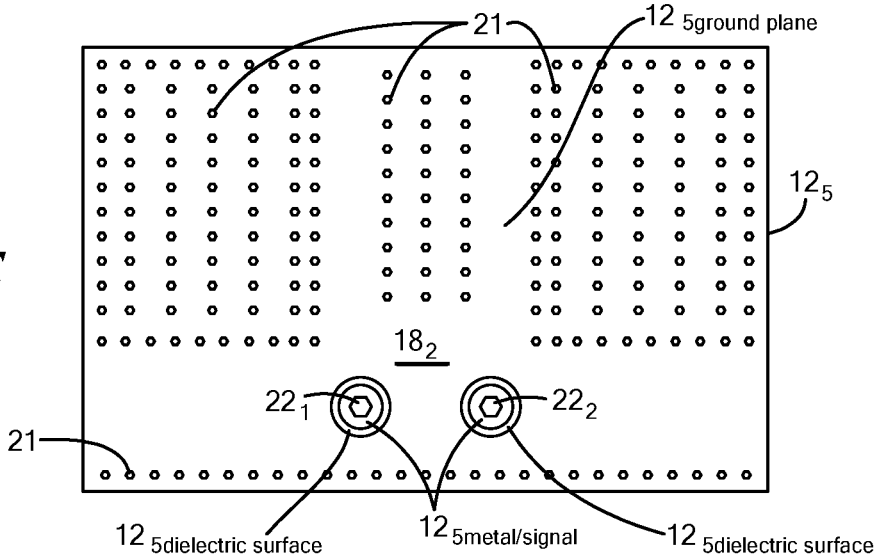
Figure 5F:
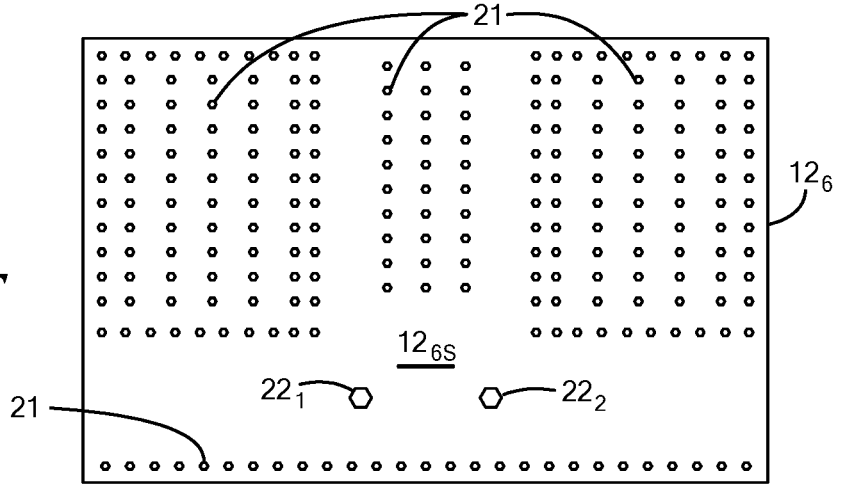
Figure 5G:
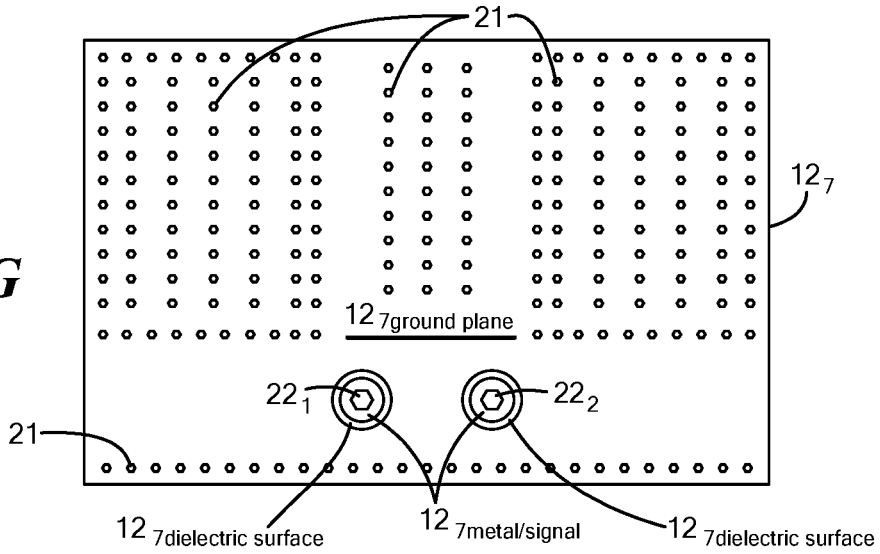
Figure 5H:
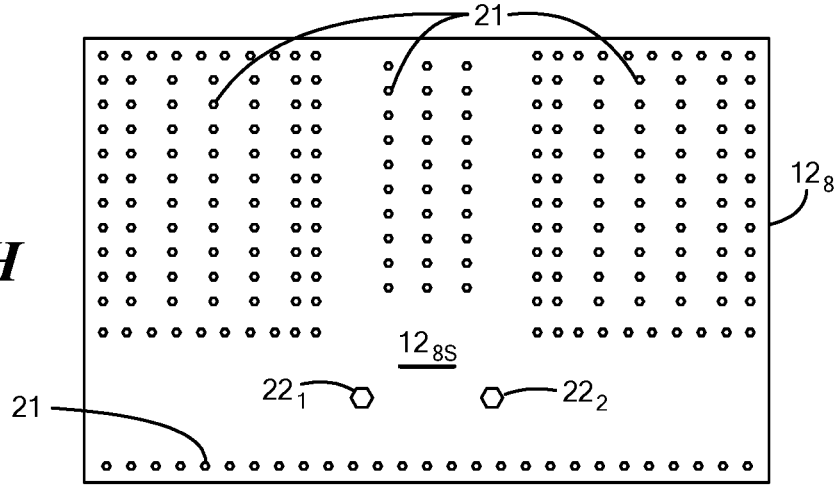
Figure 5I:
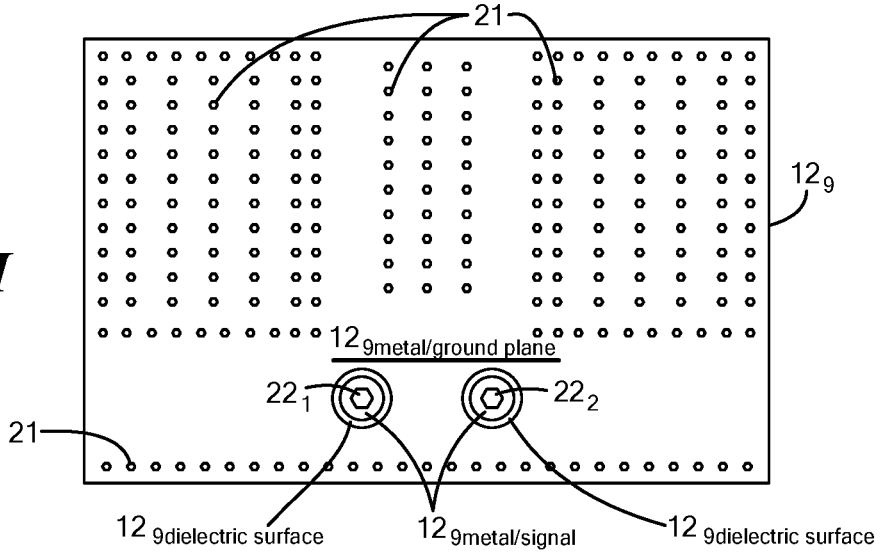
Figure 5J:
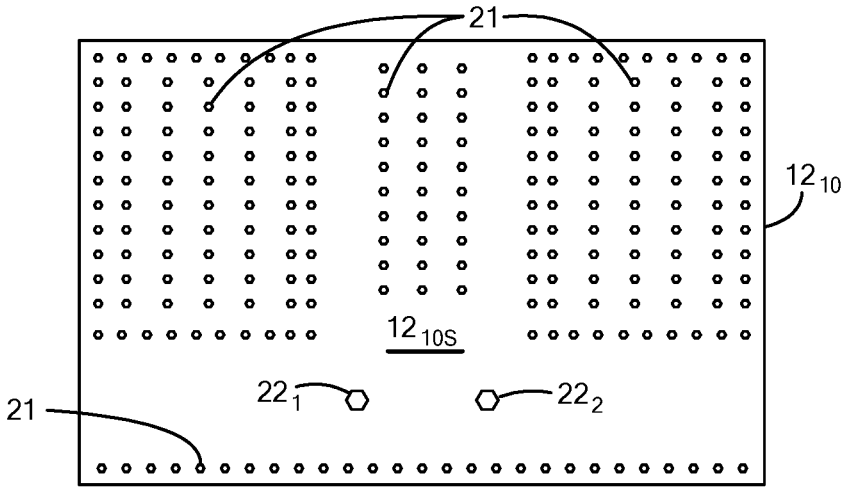
Figure 5K:
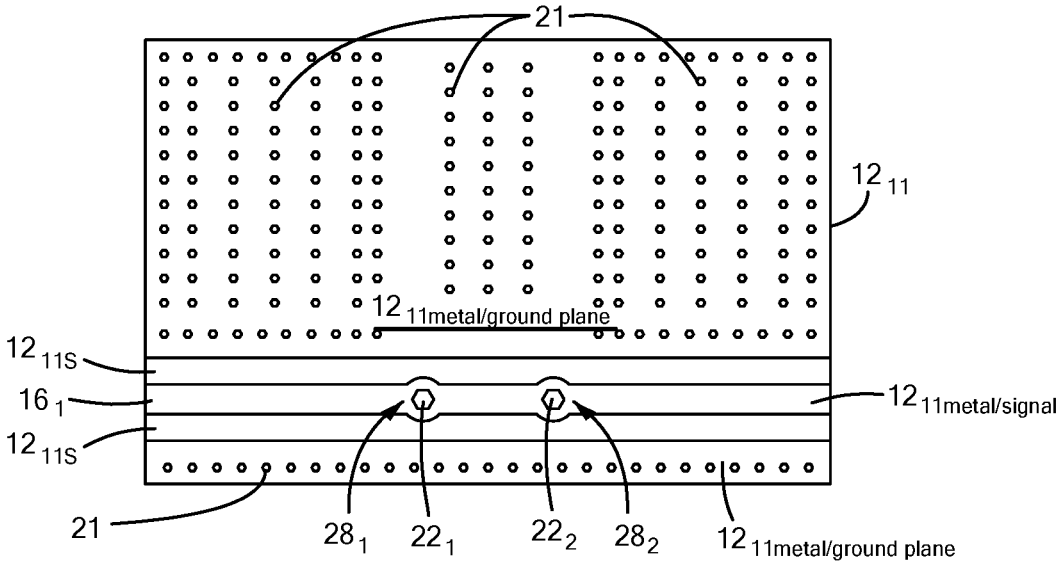
Figure 5L:
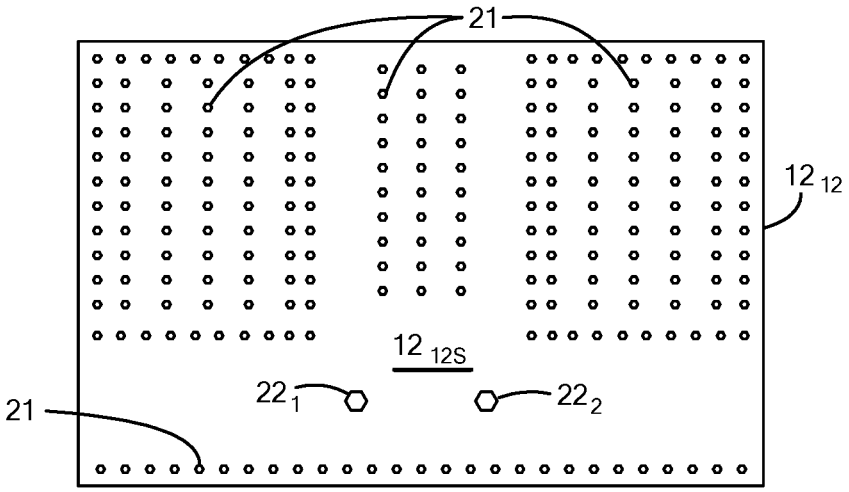
Figure 5M:
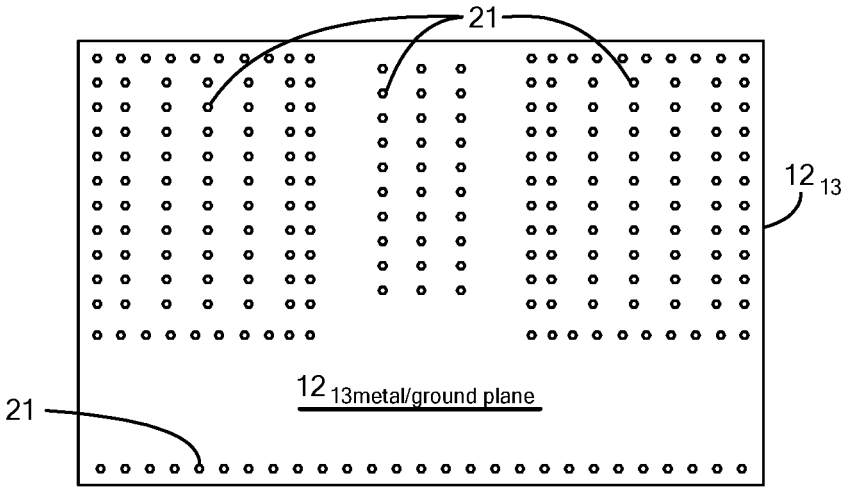
Figure 6:
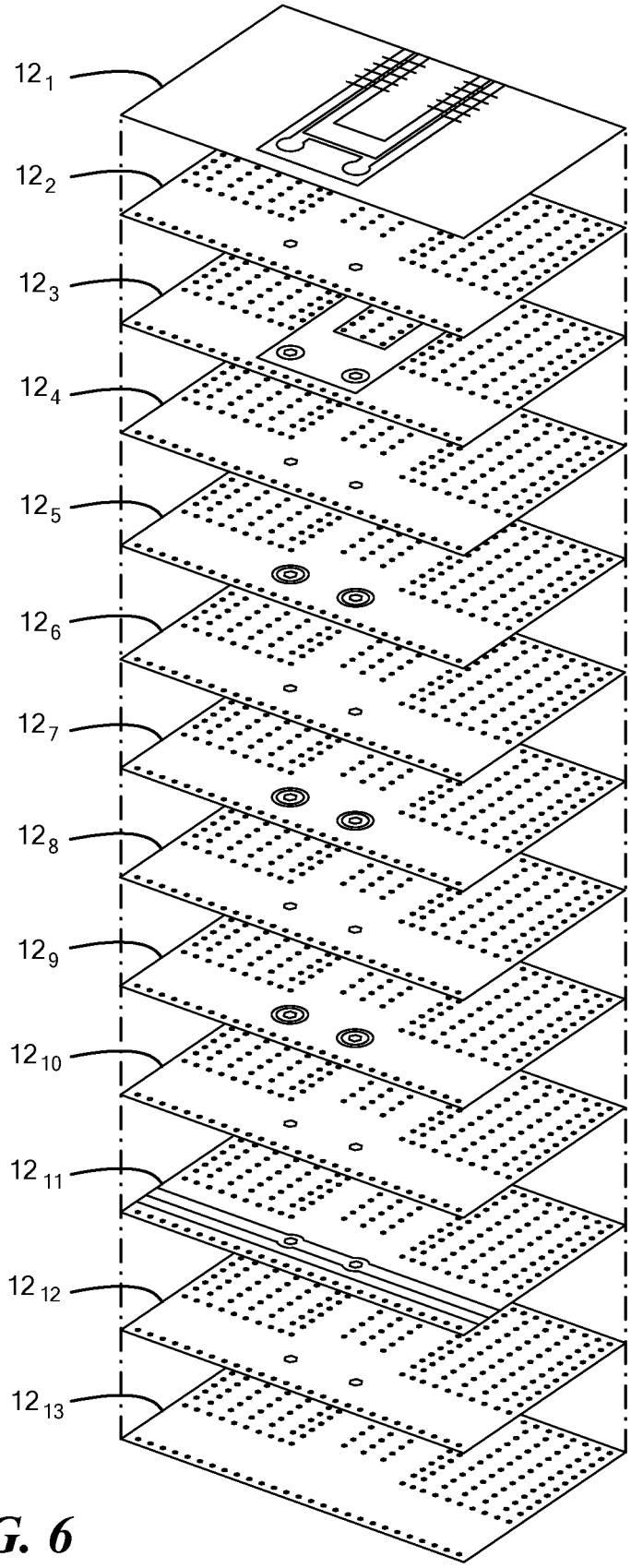
FIG. 6 is a simplified, exploded, diagrammatic schematic sketch of the branchline coupler of FIG. 4 useful in further understanding the arrangement of the printed circuit boards of FIG. 5A-5M of the branchline coupler of FIG. 4 according to the disclosure.

Referring also to FIGS. 5A-5M, a pair of main transmission lines $\mathbf{14}_1$, $\mathbf{14}_2$, (FIG. 5) here microstrip transmission lines, each one having a signal strip conductor $\mathbf{16}_1$, $\mathbf{16}_2$, respectively, formed on the upper surface of boards $\mathbf{12}_{11}$ and $\mathbf{12}_1$, respectively, as shown in FIGS. 5K and 5A, respectively, and a corresponding, underlying one a pair of ground plane conductors $\mathbf{18}_1$,$\mathbf{18}_2$, respectively, formed by conductive sheet portions $\mathbf{12}_{13\,metal/ground\ plane}$ and $\mathbf{12}_{3\,metal/ground\ plane}$ on boards $\mathbf{12}_{13}$ and $\mathbf{12}_3$, respectively, as shown in FIGS. 5M and 5C, respectively, disposed in the X-Y horizontal plane to support an electric field along the vertical Z-axis disposed, each one of the main transmission lines $\mathbf{14}_1$, $\mathbf{14}_2$ being disposed on different horizontal levels of the support structure 12; and a pair of shunt transmission lines, $\mathbf{26}_1$, $\mathbf{26}_2$, (FIG. 5) here coaxial type transmission lines $\mathbf{22}_1$, $\mathbf{22}_2$, having: (a) grounded outer conductors formed by conductive sheet $\mathbf{24}_1$, $\mathbf{24}_2$, $\mathbf{24}_3$, respectively, formed by conductive sheet portions $\mathbf{12}_{5\,metal/ground\ plane}$, $\mathbf{12}_{7\,metal\ ground\ plane}$, and $\mathbf{12}_{9\,metal\ ground\ plane}$ on boards $\mathbf{12}_5$, $\mathbf{12}_7$ and $\mathbf{12}_9$, respectively (FIGS. 5E, 5G and 5I, respectively, the conductive sheets being spaced vertically less than a quarter wavelength at the nominal operating wavelength of the branchline coupler in order to appear electrically as a continuous conductor; and inner signal conductors $\mathbf{26}_1$, $\mathbf{26}_2$, respectively, formed by conductive signal vias $\mathbf{22}_1$, and $\mathbf{22}_2$ formed by conductive portions of conductive sheets on boards, respectively, $\mathbf{12}_2$-$\mathbf{12}_{12}$ as shown in FIG. 5B through FIG. 5L, the coaxial type transmission lines $\mathbf{22}_1$, $\mathbf{22}_2$, extending vertically and laterally spaced, and disposed in the support structure 12 to support an electric field along the X-Y horizontal planes.

A first one of the pair of shunt transmission lines $\mathbf{26}_1$, $\mathbf{26}_2$, (FIG. 5) here shunt transmission line $\mathbf{26}_1$ is coupled between: one region $\mathbf{28}_1$ on board $\mathbf{12}_{11}$ (FIG. 5K) of a first one of the pair of main transmission lines $\mathbf{14}_1$,$\mathbf{14}_2$, here main transmission line $\mathbf{14}_1$ and a first end $\mathbf{30}_1$ on board $\mathbf{12}_1$ (FIG. 5A) of a second one of the pair of main transmission lines $\mathbf{14}_1$, $\mathbf{14}_2$, here main transmission line $\mathbf{14}_2$. A second one of the pair of shunt transmission lines $\mathbf{26}_1$, $\mathbf{26}_2$, here shunt transmission line 26 is coupled between a second region $\mathbf{28}_2$ on board $\mathbf{12}_{11}$ (FIG. 5K) of the first one of the pair of main transmission lines $\mathbf{14}_1$,$\mathbf{14}_2$, here main transmission line $\mathbf{14}_1$ has a region $\mathbf{28}_1$ laterally spaced from a second region $\mathbf{28}_2$ on board $\mathbf{12}_{11}$.

Here the branchline coupler structure 10 includes: a pair of phase adjusting sections, $\mathbf{32}_1$,$\mathbf{32}_2$, FIG. 5, each one of the pair of phase shifting sections $\mathbf{32}_1$, $\mathbf{32}_2$ being coupled to a corresponding one of a pair of shunt transmission line sections $\mathbf{26}_1$,$\mathbf{26}_2$, respectively and a corresponding one of the second one of the pair of main transmission lines, respectively, at a corresponding one of the regions $\mathbf{28}_1$,$\mathbf{28}_2$, respectively, as shown, through a corresponding one of pair phase shifter section transmission lines, $\mathbf{34}_1$,$\mathbf{34}_2$, (FIG. 5) respectively, here microstrip transmission lines, as shown. More particularly, phase shifter section transmission lines, $\mathbf{34}_1$,$\mathbf{34}_2$, each has a corresponding of a pair of signal strip conductors $\mathbf{38}_1$,$\mathbf{38}_2$, respectively, disposed on an upper surface of the support structure 10 (board $\mathbf{12}_1$, FIG. 5A) and extending along the Y-direction. Each one of the pair of signal strip conductors $\mathbf{38}_1$, $\mathbf{38}_2$, is disposed above a corresponding one of a pair of ground plane conductors $\mathbf{40}_1$,$\mathbf{40}_2$, respectively, here provided by a common conductor 31 pattern as shown on board $\mathbf{12}_4$ as shown in FIG. 5D) and positioned to support a vertical electric field along the Z-axis.

A plurality of, here three electrically connected ground pads $\mathbf{42}_1$, $\mathbf{42}_2$, and $\mathbf{42}_3$, are disposed on an upper surface of the support structure 10 are formed by a patterned electrical conductor 19 formed on board $\mathbf{12}_1$ (FIG. 5A), as indicted. The three ground pads $\mathbf{42}_1$, $\mathbf{42}_2$, and $\mathbf{42}_3$, are separate from one another by gaps $\mathbf{44}_1$ and $\mathbf{44}_2$, as shown, with signal strip conductors $\mathbf{38}_1$,$\mathbf{38}_2$, respectively, being disposed in gaps $\mathbf{44}_1$, $\mathbf{44}_2$, respectively, as shown. There are two sets $\mathbf{46}a_1$, $\mathbf{46}b_1$ and $\mathbf{46}a_2$, $\mathbf{46}b_2$ of electrical conductors, here bond wires, are staggered across gaps $\mathbf{44}_1$,$\mathbf{44}_2$, respectively, as shown. One portion of set $\mathbf{46}a_1$, $\mathbf{46}b_1$, here set $\mathbf{46}a_1$ has one end connected to ground pad $\mathbf{42}_1$ and an opposite end connected to signal strip conductor $\mathbf{38}_1$ and here set $\mathbf{46}b_1$ has one end connected to ground pad $\mathbf{42}_2$ and an opposite end connected to signal strip conductor $\mathbf{38}_1$. It is noted that the electrical conductors in set $\mathbf{46}a_1$ and set $\mathbf{46}b_1$ are disposed successive along over the gap $\mathbf{44}_1$ with each one the conductors in set $\mathbf{46}a_1$ being staggered with respect to the each one of the conductors in set $\mathbf{46}b_1$, as shown. To put it another way, each one of the conductors in set $\mathbf{46}b_1$ is disposed between a pair of the conductors in set $\mathbf{46}a_1$, as shown. Likewise, it is noted that the electrical conductors in set $\mathbf{46}a_2$ and set $\mathbf{46}b_2$ are disposed successive along over the gap $\mathbf{44}_2$ with each one the conductors in set $\mathbf{46}a_2$ being staggered with respect to the each one of the conductors in set $\mathbf{46}b_2$, as shown. To put it another way, each one of the conductors in set $\mathbf{46}b_2$ is disposed between a pair of the conductors in set $\mathbf{46}a_2$, as shown.

Figure 7:
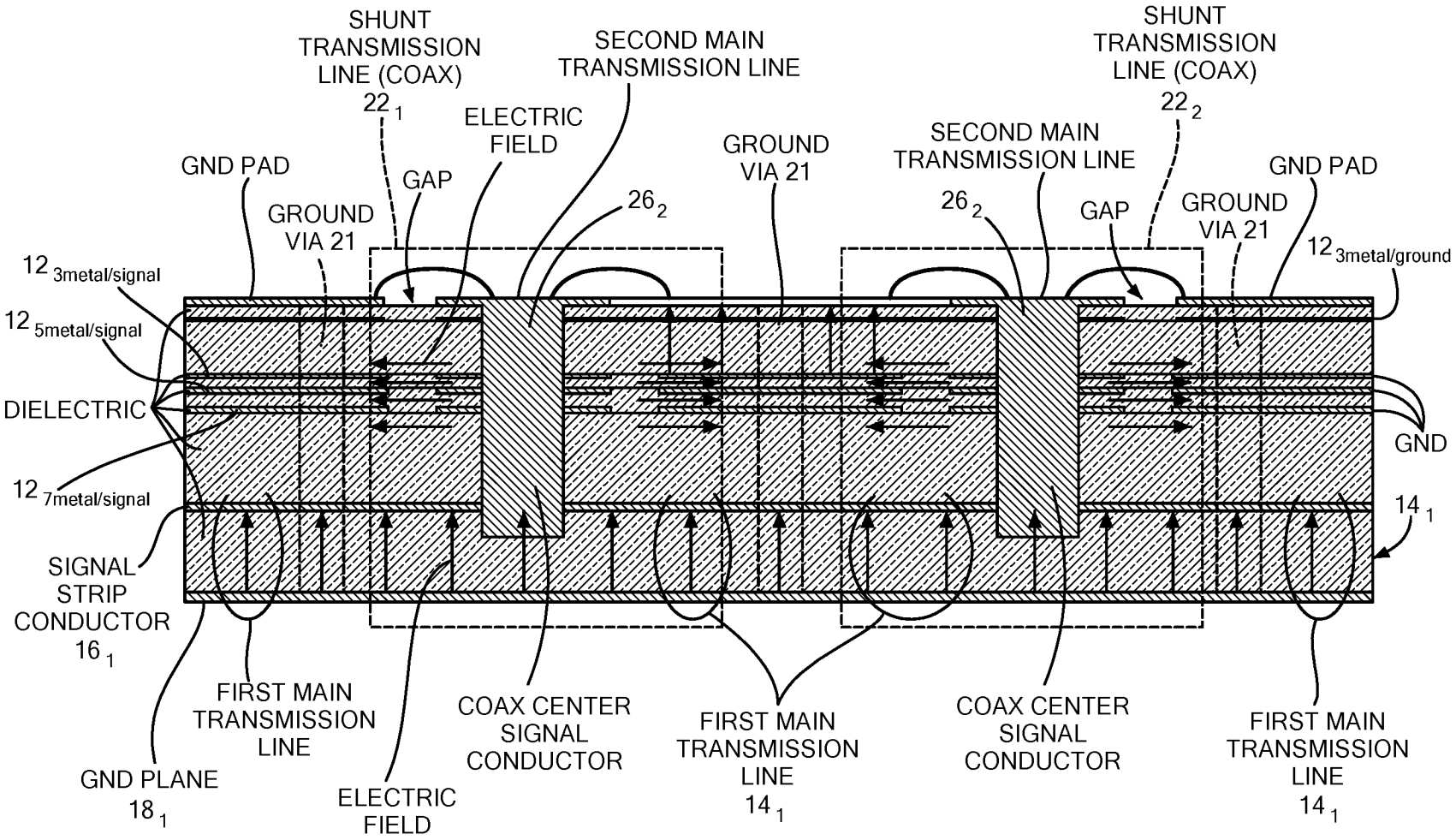
FIG. 7 is a cross sectional view of the inner portion designated as 7-7 in FIG. 4A of the branchline coupler of FIG. 4 according to the disclosure.

The ground plane conductors on printed circuit boards $\mathbf{12}_1$, $\mathbf{12}_3$, $\mathbf{12}_5$, $\mathbf{12}_7$, $\mathbf{12}_9$, $\mathbf{12}_{11}$ and $\mathbf{12}_{13}$—(FIGS. 5A, 5C, 5E, 5G, 5I, 5K and 5M, respectively), and the three ground pads $\mathbf{42}_1$, $\mathbf{42}_2$, and $\mathbf{42}_3$ on board $\mathbf{12}_1$ (FIG. 5A), are connected together with conductive ground vias 21, as shown in FIGS. 5A-5M. Boards $\mathbf{12}_2$, $\mathbf{12}_4$, $\mathbf{12}_6$, $\mathbf{12}_8$, $\mathbf{12}_{10}$, $\mathbf{12}_{12}$ (FIGS. 5B, 5D, 5F, 5H, 5J, and 5L), have conductive vias 21 with boards $\mathbf{12}_4$, $\mathbf{12}_6$, $\mathbf{12}_8$, $\mathbf{12}_{10}$ and $\mathbf{12}_{12}$ also having portions of the center signal conductor of the coaxial shunt transmission lines $\mathbf{22}_1$, $\mathbf{22}_2$ as shown in FIG. 7.

The boards $\mathbf{12}_1$-$\mathbf{12}_{13}$ are formed as shown above and described above in FIGS. 5A-M except for the ground vias 21 and inner signal conductors $\mathbf{26}_1$, $\mathbf{26}_2$. The formed boards $\mathbf{12}_1$-$\mathbf{12}_{13}$ are then stacked and bonded together with any conventional dielectric bonding material, not shown. The ground vias 19 and conductive vias of the inner signal conductors $\mathbf{26}_1$, $\mathbf{26}_2$ are formed by first etching or drilling holes in the bonded structure from the bottom or backside of the bonded structure vertically through such structure starting from the back of board $\mathbf{12}_{13}$ and then then filling the holes with a suitable electrically conductive material. In order to prevent the conductive material from electrically connecting the inner signal conductors $\mathbf{26}_1$, $\mathbf{26}_2$. To the ground plane conductor on board $\mathbf{12}_{13}$, the portion of the inner signal conductors $\mathbf{26}_1$, $\mathbf{26}_2$, conductive material of the inner signal conductors $\mathbf{26}_1$, $\mathbf{26}_2$ making such connection are removed by back-drilling or by timed etching for example and removed conductive material is replaced with a dielectric material.

Thus, in FIG. 5A, board $\mathbf{12}_1$: numerical designation 19 is conductive sheet patterned to form pads $\mathbf{42}_1$, $\mathbf{42}_2$ and $\mathbf{42}_3$; signal strip conductors $\mathbf{38}_1$,$\mathbf{38}_2$, main transmission line signal $\mathbf{14}_2$ strip conductor $\mathbf{16}_2$; top portions of inner signal conductors $\mathbf{26}_1$, $\mathbf{26}_2$; a first and second ends of the main transmission line $\mathbf{14}_{21}$ signal strip conductors $\mathbf{30}_1$, $\mathbf{30}_2$; exposed portion of the surface of the dielectric portions of board $\mathbf{12}_1$ being designed $\mathbf{12}_{1S}$.

In FIG. 5B, board $\mathbf{12}_2$: dielectric surface of board $\mathbf{12}_{2S}$ and conductive vias $\mathbf{12}_{2signal}$ for center signal conductors of coaxial shunt transmission $\mathbf{22}_1$, $\mathbf{22}_2$ exposed portions of the dielectric surface being designated $\mathbf{12}_{2S}$.

In FIG. 5C, board $\mathbf{12}_3$: patterned conductor $\mathbf{12}_{3ground\ plane}$ serves as a ground plane conductor $\mathbf{18}_2$ for signal strip conductor $\mathbf{16}_2$ of the main transmission line $\mathbf{14}_2$ and as the ground plane conductors $\mathbf{40}_2$ for strip conductors $\mathbf{38}_2$ of the phase shifter transmission line $\mathbf{34}_2$; numerical designation $\mathbf{12}_{3S}$ is the dielectric exposed surface portions of the dielectric board $\mathbf{12}_3$, numerical designation $\mathbf{12}_{3metal/signal}$ designating an outer portion of the inner signal conductors $\mathbf{26}_1$, $\mathbf{26}_2$.

In FIG. 5D, board $\mathbf{12}_4$: numerical designation $\mathbf{12}_{4S}$ is the exposed portions of the surface of board $\mathbf{12}_4$.

In FIG. 5E, board $\mathbf{12}_5$: numerical designation $\mathbf{12}_{5ground\ plane}$ is patterned conductor providing a ground plane with exposed dielectric portions of the dielectric board $\mathbf{12}_5$ being designated $\mathbf{12}_{5S}$; numerical designation $\mathbf{12}_{5metal/signal}$ designates an outer portion of the inner signal conductors $\mathbf{26}_1$, $\mathbf{26}_2$.

In FIG. 5F, board $\mathbf{12}_6$: numerical designation $\mathbf{12}_{6S}$ being portions of the surface of dielectric board $\mathbf{12}_6$.

In FIG. 5G, board $\mathbf{12}_7$: numerical designation $\mathbf{12}_{7ground\ plane}$ is patterned conductor providing a ground plane with exposed dielectric portions of the dielectric board $\mathbf{12}_7$ being designated $\mathbf{12}_{7S}$; numerical designation $\mathbf{12}_{7metal/signal}$ designates an outer portion of the inner signal conductors $\mathbf{26}_1$, $\mathbf{26}_2$.

In FIG. 5H, board $\mathbf{12}_8$: numerical designation $\mathbf{12}_{8S}$ being portions of the surface of dielectric board $\mathbf{12}_8$.

In FIG. 5I, board $\mathbf{12}_9$: numerical designation $\mathbf{12}_{9ground\ plane}$ designates patterned conductor providing a ground plane with exposed dielectric portions of the dielectric board $\mathbf{12}_9$ being designated $\mathbf{12}_{9S}$; numerical designation $\mathbf{12}_{9metal/signal}$ designating an outer portion of the inner signal conductors $\mathbf{26}_1$, $\mathbf{26}_2$.

In FIG. 5J, board $\mathbf{12}_{10}$, numerical designation $\mathbf{12}_{10S}$ being portions of the surface of dielectric board $\mathbf{12}_{10}$.

In FIG. 5K, board $\mathbf{12}_{11}$, numerical designation $\mathbf{12}_{11ground\ plane}$ designates patterned conductor providing a ground plane with exposed dielectric portions of the dielectric board $\mathbf{12}_{11}$ being designated $\mathbf{12}_{11S}$; numerical designation $\mathbf{12}_{1metal/signal}$ designating the signal strip conductor $\mathbf{16}_1$ of the main transmission line $\mathbf{14}_1$.

In FIG. 5L, board $\mathbf{12}_{12}$, numerical designation $\mathbf{12}_{12S}$ designates portions of the surface of dielectric board $\mathbf{12}_{12}$.

In FIG. 5M, board $\mathbf{12}_{13}$, numerical designation $\mathbf{12}_{13}$ designating the ground plane conductor $\mathbf{18}_1$ of the main transmission line $\mathbf{14}_1$.

A number of embodiments of the disclosure have been described. Nevertheless, it will be understood that various modifications may be made without departing from the spirit and scope of the disclosure. For example, the phase shifting section need not use bonding wires but techniques described in U.S. Pat. No. 10,243,246 Issued Mar. 26, 2019, entitled "Phase Shifter Including a Branchline Coupler Having Phase Adjusting Sections Formed By Connectable Conductive Pads", Inventors Laighton et at., assigned to the same assignee as the present invention may be used. Further, the coaxial, vertical, shunt transmission line may be formed by arranging a plurality of vertical columns of conductor closely spaced circumferentially around a signal center conductor as described in U.S. Pat. No. 9,887,195 Issued Feb. 6, 2018, Inventors Drab et al., assigned to the same assignee as the present invention. Accordingly, other embodiments are within the scope of the following claims.

What is claimed is:

1. A branchline coupler structure, comprising:

a support structure;

a pair of main transmission lines disposed on different horizontal levels of the support structure;

a pair of shunt transmission lines, vertically disposed and laterally spaced, and disposed in the support structure;

wherein a first one of the pair of shunt transmission lines is coupled between: one region of a first one of the pair of main transmission lines and a first end of a second one of the pair of main transmission line;

wherein a second one of the pair of shunt transmission lines is coupled between a second region of the first one of the pair of main transmission lines, laterally spaced from the first region, and a second end of the second one of the main transmission lines; and wherein the pair of shunt transmission lines propagate energy vertically with the electric field of such energy being disposed horizontally.

2. The branchline coupler structure recited in claim 1 including:

a pair of phase adjusting sections, each one of the pair of phase shifting sections being coupled to a corresponding one of a pair of shunt transmission line sections through a corresponding one of pair phase shifter section transmission lines, the pair phase shifter section transmission lines being disposed on an upper surface of the support structure:

a ground pad disposed on an upper surface of the support structure, separate from the signal strip conductors of the phase shifter section transmission lines by gaps; and a plurality of electrical conductors, bridging the gaps, disposed successive along over the gaps, each one of the plurality of electrical conductors having one end to connect the ground pad and a second end connected to one of the phase shifter transmission line sections.

3. The branchline coupler structure recited in claim 2 including:

a second ground pad disposed on an upper surface of the support structure, separate from the signal strip conductors of the pair of phase shifter section transmission lines by a pair of gaps;

a second plurality of electrical conductors, bridging the pair of gaps, disposed successive along over the pair of gaps, each one of the second plurality of electrical conductors having one end connect the second ground pad and a second end connected to the corresponding one of the phase shifter transmission line sections.

4. The branchline coupler structure recited in claim 3 wherein the first-mentioned plurality of electrical conductors and the second plurality of electrical conductors are staggered along the first mentioned gap and a corresponding one of the pair of gaps.

5. The branchline coupler structure recited in claim 1 wherein the pair of main transmission lines propagate energy horizontally with the electric field of such energy being disposed vertically.

6. A branchline coupler structure, comprising:

a support structure;

a pair of main transmission lines disposed on different horizontal levels of the support structure;

a pair of shunt transmission lines, vertically disposed and laterally spaced, and disposed in the support structure;

wherein a first one of the pair of shunt transmission lines is coupled between, one region of a first one of the pair of main transmission lines and a first end of a second one of the pair of main transmission line;

wherein a second one of the pair of shunt transmission lines is coupled between a second region of the first one of the pair of main transmission lines, laterally spaced from the first region, and a second end of the second one of the main transmission lines; and wherein the pair of main transmission lines propagate energy horizontally with the electric field of such energy being disposed vertically.

7. A branchline coupler structure, comprising:

a pair of main transmission lines;

a pair of shunt transmission lines, a first one of the pair of shunt transmission lines is coupled between: one region of a first one of the pair of main transmission lines and a first end of a second one of the pair of main transmission line, a second one of the pair of shunt transmission lines is coupled between a second region of the first one of the pair of main transmission lines, laterally spaced from the first region, and a second end of the second one of the main transmission lines;

a pair of phase adjusting sections, each one of the pair of phase shifting sections being coupled to a corresponding one of a pair of shunt transmission line sections through a corresponding one of pair phase shifter section transmission lines;

a ground pad disposed on an upper surface of the support structure, separate from the signal strip conductors of the phase shifter section transmission lines by gaps; and a plurality of electrical conductors, bridging the gaps, disposed successive along over the gaps, each one of the plurality of electrical conductors having one end to connect the ground pad and a second end connected to one of the phase shifter transmission line sections.

8. The branchline coupler structure recited in claim 7 including:

a second ground pad disposed on an upper surface of the support structure, separate from the signal strip conductors of the pair of phase shifter section transmission lines by a pair of gaps;

a second plurality of electrical conductors, bridging the pair of gaps, disposed successive along over the pair of gaps, each one of the second plurality of electrical conductors having one end connect the second ground pad and a second end connected to the corresponding one of the phase shifter transmission line sections.

9. The branchline coupler structure recited in claim 8 wherein the first-mentioned plurality of electrical conductors and the second plurality of electrical conductors are staggered along the first mentioned gap and a corresponding one of the pair of gaps.

* * * * *